US006111556A

United States Patent [19]

Moon

[11] Patent Number: 6,111,556

[45] Date of Patent: Aug. 29, 2000

[54] ENERGY RECOVERY SUSTAIN CIRCUIT FOR AC PLASMA DISPLAY PANEL

[75] Inventor: Seong-Hak Moon, Kyungki-do, Rep. of Korea

[73] Assignee: LG Electronics Inc., Seoul, Rep. of Korea

[21] Appl. No.: 09/039,421

[22] Filed: Mar. 16, 1998

[30] Foreign Application Priority Data

Mar. 17, 1997 [KR] Rep. of Korea ..... 97-08929

[51] Int. Cl.[7] ..... G09G 3/28

[52] U.S. Cl. ..... 345/60; 345/66; 345/68

[58] Field of Search ..... 345/60, 61, 62, 345/66, 67, 68, 69, 74, 76, 204; 315/169.4, 169.3, 167; 313/231.31, 231.41

[56] References Cited

U.S. PATENT DOCUMENTS

| | | | |
|---|---|---|---|
| 4,866,349 | 9/1989 | Weber et al. | 345/68 |
| 5,654,728 | 8/1997 | Kanazawa et al. | 345/68 |
| 5,670,974 | 9/1997 | Ohba et al. | 345/66 |

*Primary Examiner*—Regina Liang

*Attorney, Agent, or Firm*—Fleshner & Kim, LLP

[57] ABSTRACT

Energy recovery sustain circuit for an AC plasma display panel, is disclosed, having first, and second energy recovery sustain driving parts for supplying sustain pulses of Vo volt to a load capacitor in the AC plasma display panel, each including an output terminal, an inductor, a first capacitor, a second capacitor, first capacitor discharging means, second capacitor discharging means, first capacitor charging means, second capacitor charging means, first to fourth voltage sustaining means, thereby, since a plurality of capacitors are provided for temporary storage of a discharge energy of the load capacitor, which is charged back to the load capacitor many times, the present invention has an advantage in that a power consumption of the panel can be reduced than the background art panel in a sustained driving, the system giving and taking charge and discharge energies to/from the load capacitor provided in the present invention allows linear compensation of the capacitance of the load capacitor, and as the present invention provides a rising time of the sustain pulse of a maximum resonant point to the panel regardless of the variation of the capacitance of the load capacitor, an energy loss can be reduced and a stable sustained driving of the panel is possible.

31 Claims, 6 Drawing Sheets

ENERGY RECOVERY SUSTAIN CIRCUIT FOR AC PLASMA DISPLAY PANEL

BACKGROUND OF THE INVENTION

1. Field of the Invention

The present invention relates to a circuit for driving an AC plasma display panel at a low power, and more particularly, to an energy recovery sustain circuit for an AC plasma display panel.

2. Discussion of the Related Art

The AC plasma display panel is in general one of luminous device which uses gaseous discharge within each discharge cell for displaying an image. Because the AC plasma display panel is simple to fabricate, easy to fabricate a large sized screen, and fast in response, it is spot lighted as a direct view image display with a large screen, particularly as a display directed to an age of HDTV.

The AC plasma display panel, provided with electrodes, a dielectric layer and a discharge gas, acts as a load capacitor which charges and discharges for itself. However, the large power consumption in driving the AC plasma display panel, i.e., in the charging and discharging of the load capacitor, particularly, when the size is greater, has been a great obstacle for making this AC plasma display panel popular. Accordingly, instead of a general sustain circuit, use of an energy recovery sustain circuit for sustained driving of the panel is suggested, for pursuing a low power consumption of a driving circuit which drives the AC plasma display panel. The energy recovery sustain circuit is a circuit provided with an inductor which forms an LC resonance circuit with a load capacitor in the panel for recovery and temporary storage of an energy lost during discharge of the load capacitor and supplying the energy for the next time charging of the load capacitor, thereby reducing an energy loss in the sustained driving of the panel.

FIG. 1 illustrates a typical type energy recovery sustain circuit, one of background art energy recovery sustain circuit, provided with a system including first and second energy recovery sustain driving parts 10 and 20 of identical systems, for supplying sustain pulses of a $V_o$ voltage to a load capacitor $C_L$ in the AC plasma display panel. Each of the first and second energy recovery sustain driving parts 10 and 20 is provided with an output terminal OUT connected to the load capacitor $C_L$, an inductor L0 having one end connected to the load capacitor $C_L$ through the output terminal OUT to form a resonance circuit, a capacitor C1 having a capacitance greater than the load capacitor $C_L$ and one end grounded for charging and discharging Vo/2 voltage thereto/therefrom, capacitor discharging means 11 connected to the other end of the capacitor C1 and the other end of the inductor L0 for discharging the Vo/2 voltage charged in the capacitor C1 so as to charge the load capacitor $C_L$ from 0 to Vo, first voltage sustaining means 12 connected to the output terminal OUT for sustaining voltages $V_L$ on both sides of the load capacitor $C_L$ to Vo when the load capacitor $C_L$ is charged to Vo voltage, capacitor charging means 13 connected between the other end of the capacitor C1 and the other end of the inductor L0 for discharging the Vo voltage charged in the load capacitor $C_L$ down to 0 voltage to charge the capacitor C1 up to Vo/2 voltage, and second voltage sustaining means 14 connected to the output terminal OUT for sustaining a voltage $V_L$ on both sides of the load capacitor $C_L$ at 0 when the load capacitor $C_L$ is discharged down to 0 voltage. The capacitor discharging means 11 is provided with first switching means Q1 having one end connected to the other end of the capacitor C1 for being at turned on while the load capacitor $C_L$ is charged from 0 to Vo voltage, and a first diode D1 having an anode connected to the other end of the first switching means Q1 and a cathode connected to the other end of the inductor L0 for receiving a current $I_L$ discharged from the capacitor C1 through the first switching means Q1 and providing to the inductor L0 while the first switching means Q1 is at turned on. The capacitor charging means 13 is provided with second switching means Q2 having one end connected to the other end of the capacitor C1 for being at turned on while the load capacitor $C_L$ is discharged from Vo to 0 voltage, and a second diode D2 having a cathode connected to the other end of the second switching means Q2 and an anode connected to the other end of the inductor L0 for receiving a current $-I_L$ discharged from the load capacitor $C_L$ through the inductor L0 and providing to the second switching means Q2 while the first switching means Q1 is at turned on. The first voltage sustaining means 12 is provided with a third diode D3 having a cathode connected both to a Vo power source and the output terminal OUT, and third switching means Q3 having one end connected an anode of the third diode D3 and the other end connected to the Vo power source for being turned on when the load capacitor $C_L$ is charged from 0 to Vo voltage. The second voltage sustaining means 14 is provided with a fourth diode D4 having an anode connected to the output terminal OUT, and fourth switching means Q4 having one end connected to a cathode of the fourth diode D4 and the other end grounded for being turned on when the load capacitor $C_L$ is discharged from Vo to 0 voltage.

The operation of charging and discharging of the aforementioned typical type energy recovery sustain circuit will be explained with reference to FIGS. 2*a*~2*f*. FIG. 2*a* illustrates a waveform of a voltage $V_{OUT}$ at the output terminal OUT, FIG. 2*b* illustrates a waveform of a current $I_L$ flowing through the inductor L0, and FIGS. 2*c*~2*f* illustrate switching timings of the first to fourth switching means Q1, Q2, Q3 and Q4 related to the above waveforms.

In the typical type energy recovery sustain circuit, when the entire system is turned on initially to occur many times of continuous discharges at the load capacitor $C_L$, a current of discharge flows from the load capacitor $C_L$ to respective capacitor C1 through the inductors L0 of the first, and second energy recovery sustain driving part 10 and 20, to charge to respective capacitors C1 a Vo/2 volt. When a Vo/2 volt is charged in each of the capacitors C1 of the first, and second recovery sustain driving parts 10 and 20, periodic charging and discharging is occurred between the typical energy recovery sustain circuit and the load capacitor $C_L$ at proper intervals, making the energy recovery sustain drive for the AC plasma display panel. In this instance, the discharge in the load capacitor $C_L$ is a sustain discharge for the AC plasma display panel. One cycle of the periodic charging and discharging between the typical energy recovery sustain circuit and the load capacitor $C_L$ has four intervals, operations in each of which are different from one another.

<T1 INTERVAL>

In the T1 interval, the capacitors C1 of the first, and second energy recovery sustain driving parts 10 and 20 are discharged to charge the load capacitors $C_L$ with the discharge energies. As shown in FIG. 2*c*, in this T1 interval, only the first switching means Q1 in the first, and second energy recovery sustain driving parts 10 and 20 are turned on, while the rest switching means Q2, Q3 and Q4 are left turned off as shown in FIGS. 2*d*~2*f*. When the first switching means Q1 in the first, and second energy recovery sustain driving parts 10 and 20 are turned on, the Vo/2 volt charged in respective capacitors C1 are discharged, to flow a discharge current $I_L$ caused by the Vo/2 to the load capacitors $C_L$ through the first switching means Q1, the first diodes D1 and inductors L0. At the end, as shown in FIG. 2*a*, the load capacitors $C_L$ are charged up to Vo volt in T1 interval by the discharge current $I_L$ from the first, and second energy recovery sustain driving parts 10 and 20, respectively. Accordingly, as shown in FIG. 2*a*, in this interval, a waveform rising from 0 to Vo, i.e., a rising section of the sustain pulse is shown at the output terminal OUT.

<T2 INTERVAL>

In the T2 interval after the T1 interval, voltages $V_L$ at both ends of the load capacitor $C_L$ is sustained at Vo, to charge the Vo volt to the load capacitors $C_L$, continuously. As shown in FIG. 2*e*, in this T2 interval, only the third switching means Q3 in the first, and second energy recovery sustain driving parts 10 and 20 are turned on, while the rest switching means Q1, Q2 and Q4 are left turned off as shown in FIGS. 2*c*, 2*d* and 2*f*. When the third switching means Q3 in the first, and second energy recovery sustain driving parts 10 and 20 are turned on, a voltage from the Vo power source is provided to the output terminal OUT through the third switching means Q3 and the third diode D3. As a result, as shown in FIG. 2*a*, the Vo volt is continuously charged to the load capacitors $C_L$. That is, since the voltage V1 at both ends of the capacitor C1 is lower than the voltage $V_L$ at both ends of the load capacitor $C_L$ in this T2 interval, as shown in FIG. 2*b*, no discharge current $I_L$ flows through the inductor L0. Therefore, for continuous charging to the load capacitors $C_L$, it is necessary to provide the Vo volt to the output terminal OUT. Accordingly, as shown in FIG. 2*a*, in the T2 interval, a waveform held at the Vo volt, i.e., a sustained section of the sustain pulse is shown at the output terminal OUT.

<T3 INTERVAL>

In the T3 interval after the T2 interval, energies discharged from the load capacitors $C_L$ are charged in the capacitors C1 in the first and second energy recovery sustain driving parts 10 and 20, respectively. As shown in FIG. 2*d*, in this T3 interval, only the second switching means Q2 in the first, and second energy recovery sustain driving parts 10 and 20 are turned on, while the rest switching means Q1, Q3 and Q4 are left turned off as shown in FIGS. 2*c*, 2*e* and 2*f* When the second switching means Q2 in the first, and second energy recovery sustain driving parts 10 and 20 are turned on, Vo volts charged in the load capacitors $C_L$ are discharged. Therefore, as shown in FIG. 2*b*, a discharge current $-I_L$ flows to the capacitors C1 through the second switching means Q2 via the inductors L0 and second diodes D2 in the first, and second energy recovery sustain driving parts 10 and 20. As a result, during the T3 interval, the capacitors C1 are charged of Vo/2 volts by the discharge current $-I_L$ from the load capacitors $C_L$. Therefore, as shown in FIG. 2*a*, in the T3 interval, a waveform falling from Vo to 0, i.e., a falling section of the sustain pulse is shown at the output terminal OUT.

<T4 INTERVAL>

In the T4 interval after the T3 interval, voltages $V_L$ at both ends of the load capacitors $C_L$ are sustained at 0. As shown in FIG. 2*f*, in this T4 interval, only the fourth switching means Q4 in the first, and second energy recovery sustain driving parts 10 and 20 are turned on, while the rest switching means Q1, Q2 and Q3 are left turned off as shown in FIGS. 2*c*~2*e*. When the fourth switching means Q4 in the first, and second energy recovery sustain driving parts 10 and 20 are turned on, the voltage at the output terminal OUT is sustained at 0 by the second voltage sustaining means 14 as shown in FIG. 2*a*. As a result, voltages $V_L$ at both ends of the load capacitors $C_L$ are sustained at 0. In this instance, the voltages $V_L$ at both ends of the load capacitors $C_L$ are lower than the voltages V1 at both ends of the capacitors C1 in the first, and second energy recovery sustain driving parts 10 and 20, causing no discharge current $-I_L$ flow through the inductors L0. In this instance, the voltages $V_L$ at both sides of the load capacitors $C_L$ are lower than the voltages V1 at both sides of the capacitors C1 in the first, and second energy recovery sustain driving parts 10 and 20, causing no discharge current $-I_L$ flow through the inductors L0. Therefore, as shown in FIG. 2*a*, in the T4 interval, a waveform held at 0 volt, i.e., a sustained 0 volt section of the sustain pulse is shown at the output terminal OUT.

A basic form of the sustain pulse provided to the load capacitors $C_L$ in the AC plasma display panel during T1 to T4 are rectangular the same as the waveform of voltage Vout at the output terminal OUT shown in FIG. 2*a*. The waveforms of a current $I_L$ of the rising section(T1 interval) and of the falling section(T3 interval) in the sustain pulse shown in FIG. 2*b* are segments of a sinusoidal wave of a resonant oscillation of which frequency is determined by an inductance of the inductor L0, a capacitance of the load capacitor $C_L$, and a capacitance of the capacitor C1. It is apparent that, if the capacitor C1 is provided to a sustain circuit for temporary storage of a discharge energy from the load capacitor $C_L$ and supplying the discharge energy as a charging energy to the load capacitor $C_L$ in the next cycle, there is reduction in an energy loss with reduction of power consumption compared to a sustain circuit without the energy recovery. For example, while a power consumption of a current sustain circuit operative at a frequency $f_0$ without the energy recovery is $P=C_L Vo^2 f_0$ during generation of sustain pulses, a power consumption of the typical type energy recovery sustain circuit is $P=C_L(Vo/2)^2 f_0$ during generation of sustain pulses, where $C_L$ is a capacitance of a load capacitor, Vo is a sustain driving voltage and $f_0$ is an operating frequency. Therefore, it can be known that the typical type energy recovery sustain circuit has a power consumption smaller than the current sustain circuit.

However, even if the background art typical type energy recovery sustain circuit reduces a power consumption of a panel driving circuit by the energy recovery action of the circuit, a capacitance of the panel still increases as the panel size increases. In the background art circuit, obtaining a maximum energy recovery efficiency is difficult in a case when a timing of recovery and a screen luminance of the panel are changed(i.e., when a number of on/off cells are different) due to difficulty in finding a maximum resonance point, causing much more power consumption in driving the panel, with subsequent increase of expenses, to require a method for reducing the power consumption.

SUMMARY OF THE INVENTION

Accordingly, the present invention is directed to a energy recovery sustain circuit for an AC plasma display panel that substantially obviates one or more of the problems due to limitations and disadvantages of the related art.

An object of the present invention is to provide an energy recovery sustain circuit which can further reduce a power consumption of an AC plasma display panel from the background art circuit.

Another object of the present invention is to provide an energy recovery sustain circuit for an AC plasma display panel, in which a fixed form of sustain pulse waves are provided to the panel regardless of a load variation caused by a change of turned on/off cells in the AC plasma display panel, for improving efficiency and a stable sustain operation of the panel.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the energy recovery sustain circuit for an AC plasma display panel, including first, and second energy recovery sustain driving parts for supplying sustain pulses of Vo volt to a load capacitor in the AC plasma display panel, each of the first, and second energy recovery sustain driving parts includes an output terminal connected to the load capacitor, an inductor having one end connected to the load capacitor through the output terminal for forming a resonant circuit, a first capacitor for charging and discharging a Vo/4 volt, a second capacitor for charging and discharging a 3Vo/4 volt, first capacitor discharging means connected between the first capacitor and the inductor for discharging the Vo/4 volt charged in the first capacitor to charge the load capacitor from 0 to Vo/2 volt, first voltage sustaining means connected to the output terminal for sustaining voltages at both ends of the load capacitor at Vo/2 when the load capacitor is charged up to Vo/2, second capacitor discharging means connected between the second capacitor and the inductor for discharging the 3Vo/4 volt charged in the second capacitor to charge the load capacitor from Vo/2 to Vo volt, second voltage sustaining means connected to the output terminal for sustaining voltages at both ends of the load capacitor at Vo when the load capacitor is charged up to Vo, second capacitor charging means connected between the second capacitor and the inductor for primary discharge of the Vo volt charged in the load capacitor down to Vo/2 volt to charge the second capacitor up to 3Vo/4, third voltage sustaining means connected to the output terminal for sustaining voltages at both ends of the load capacitor at Vo/2 when the load capacitor is discharged down to Vo/2, first capacitor charging means connected between the first capacitor and the inductor for secondary discharge of the Vo/2 volt remained in the load capacitor after the primary discharge of the load capacitor down to 0 volt to charge the first capacitor up to Vo/4 volt, and fourth voltage sustaining means connected to the output terminal for sustaining voltages at both ends of the load capacitor at 0 volt when the load capacitor is discharged down to 0 volt.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

The present invention can be embodied in different forms.

The present invention may be embodied by further including first undershoot preventing means for preventing an under shooting of the sustain pulse waveform during a discharge of the load capacitor from Vo to Vo/2 and holding voltages at both ends of the load capacitor at Vo/2 in combination with the third voltage sustaining means if the load capacitor discharges down to Vo/2 volt, second undershoot preventing means for preventing an under shooting of the sustain pulse waveform during a discharge of the load capacitor from Vo/2 to 0 volt and holding voltages at both ends of the load capacitor at 0 in combination with the fourth voltage sustaining means if the load capacitor discharges down to 0 volt, first overshoot preventing means for preventing an overshooting of the sustain pulse waveform during charging the load capacitor from 0 to Vo/2 volt, and second overshoot preventing means for preventing overshooting of the sustain pulse waveform during charging the load capacitor from Vo/2 to Vo.

The present invention may be embodied by further including an analog-to-digital converting part for digitizing an analog video data, a memory part for storing the digitized video data from the analog-to-digital converting part, a digital video data sensing part for sensing a number of bits, which can make an address discharge, from the digital video data stored in the memory part, and an energy compensating part for fixing a rising time period and a falling time period of the sustain pulse constant regardless of capacitance variation of the load capacitor by determining a capacitance of the load capacitor according to the number of bits sensed in the digital video data sensing part and making a current flowing between the first, and second energy recovery sustain driving parts and the load capacitors to be linearly compensated for the capacitance. The fixing of a falling time period implies that the falling time comes to the maximum resonance point.

Reference will now be made in detail to the preferred embodiments of the present invention, examples of which are illustrated in the accompanying drawings.

First Embodiment

Figure 1:
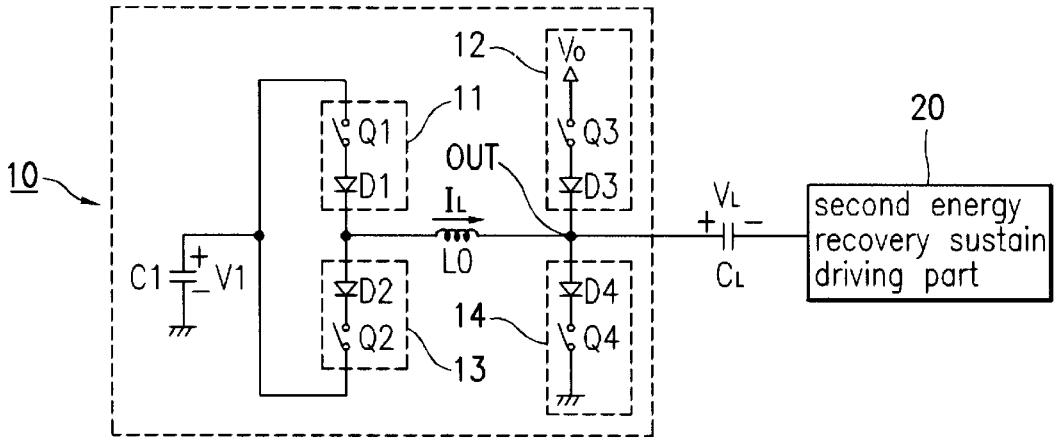
FIG.1 Background Art
FIG. 1 illustrates a system of a background art typical type energy recovery sustain circuit.
Figure 2A:
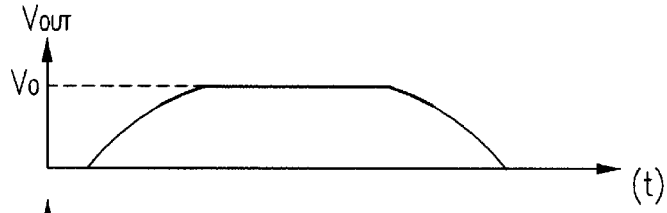
FIG.2A Background Art
FIGS. 2*a*~2*f* illustrate a voltage waveform at an output terminal shown in FIG. 1, a current waveform flowing through an inductor, and switching timings of first to fourth switching means related to the above waveforms.
Figure 2B:
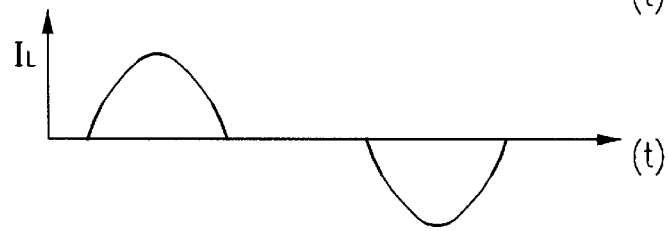
FIG.2B Background Art
Figure 2C:
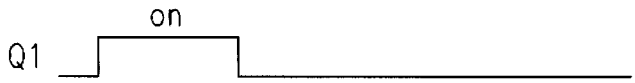
FIG.2C Background Art
Figure 2D:
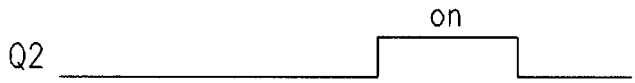
FIG.2D Background Art
Figure 2E:
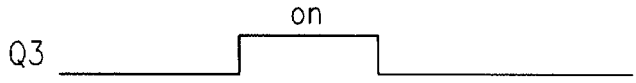
FIG.2E Background Art
Figure 2F:
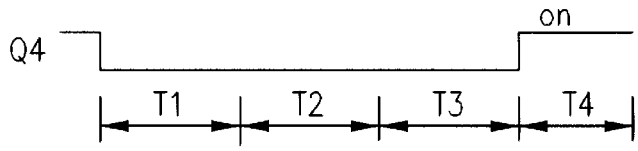
FIG.2F Background Art
Figure 3:
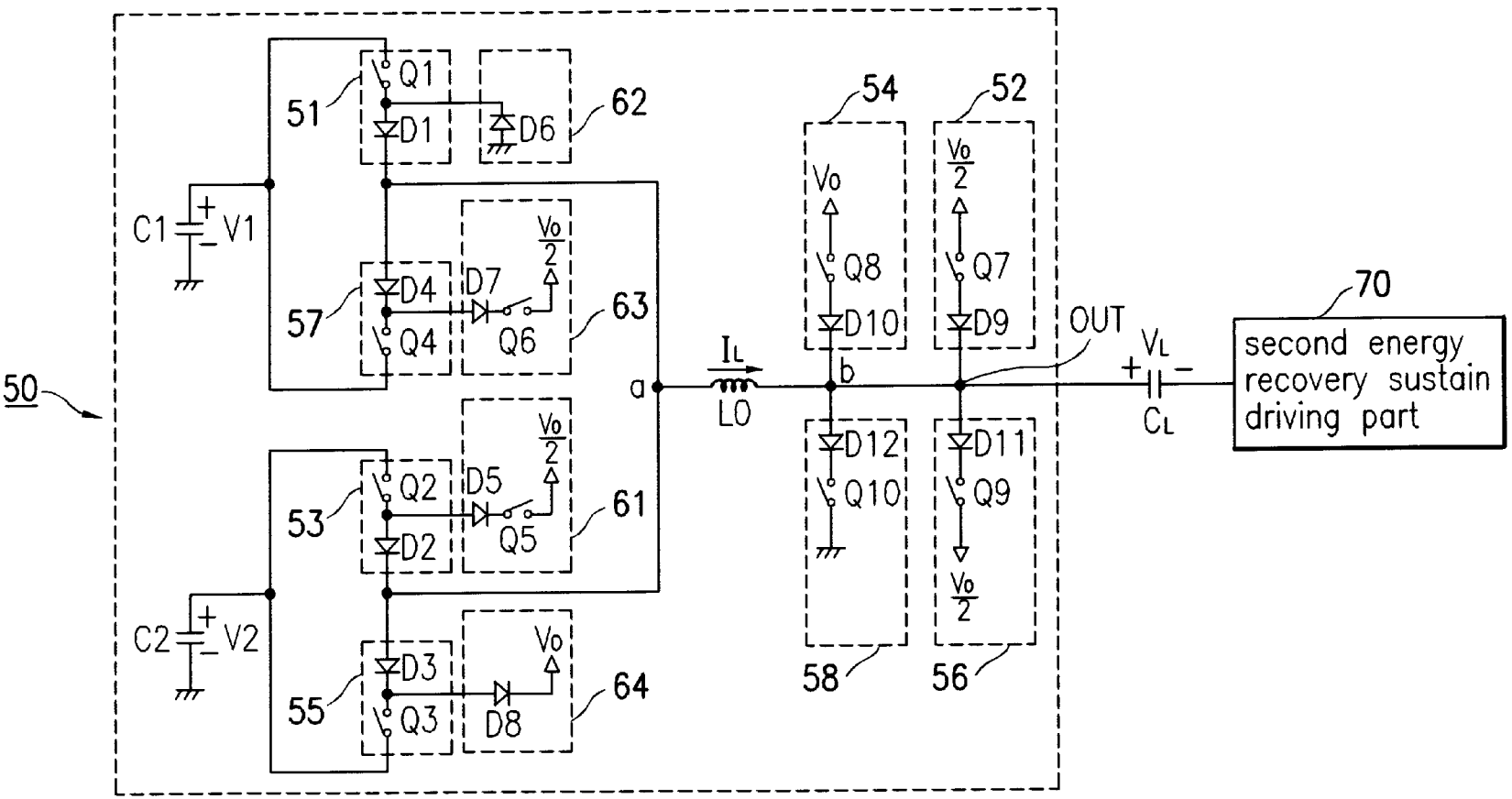
FIG. 3 illustrates a system of a 3-step type energy recovery sustain circuit in accordance with a first preferred embodiment of the present invention.

Referring to FIG. 3, the first embodiment energy recovery sustain circuit, being a 3-step type, includes first, and second energy recovery sustain driving parts 50 and 70 for supplying sustain pulses at a Vo voltage to a load capacitor $C_L$ in an AC plasma display panel. In this instance, systems of the first, and second energy recovery sustain driving parts 50 and 70 are identical. That is, each of the first, and second energy recovery sustain driving parts 50 and 70 includes an output terminal OUT connected to a load capacitor $C_L$, an inductor L0 having one end connected to the load capacitor $C_L$ through the output terminal OUT for forming an LC resonant circuit, a first capacitor C1 of a capacitance greater than the load capacitor $C_L$ and having one end grounded for charging and discharging a Vo/4 volt, a second capacitor C2 of a capacitance greater than the load capacitor $C_L$ and having one end grounded for charging and discharging a 3Vo/4 volt, first capacitor discharging means 51 connected between the other end of the first capacitor C1 and the other end of the inductor L0 for discharging the Vo/4 volt charged in the first capacitor C1 to charge the load capacitor $C_L$ from 0 to Vo/2 volt, first voltage sustaining means 52 connected to the output terminal OUT for sustaining voltages $V_L$ at both ends of the load capacitor $C_L$ at Vo/2 when the load capacitor $C_L$ is charged up to Vo/2, second capacitor discharging means 53 connected between the other end of the second capacitor C2 and the other end of the inductor L0 for discharging the 3Vo/4 volt charged in the second capacitor C2 to charge the load capacitor $C_L$ from Vo/2 to Vo volt, second voltage sustaining means 54 connected to the output terminal OUT for sustaining voltages $V_L$ at both ends of the load capacitor $C_L$ at Vo when the load capacitor $C_L$ is charged up to Vo, second capacitor charging means 55 connected between the other end of the second capacitor C2 and the other end of the inductor L0 for primary discharge of the Vo volt charged in the load capacitor $C_L$ down to Vo/2 volt to charge the second capacitor C2 up to 3Vo/4, third voltage sustaining means 56 connected to the output terminal OUT for sustaining voltages $V_L$ at both ends of the load capacitor $C_L$ at Vo/2 when the load capacitor $C_L$ is discharged down to Vo/2, first capacitor charging means 57 connected between the other end of the first capacitor C1 and the other end of the inductor L0 for secondary discharge of the Vo/2 volt remained in the load capacitor $C_L$ after the primary discharge of the load capacitor $C_L$ down to 0 volt to charge the first capacitor C1 up to Vo/4 volt, and fourth voltage sustaining means 58 connected to the output terminal OUT for sustaining voltages $V_L$ at both ends of the load capacitor $C_L$ at 0 when the load capacitor $C_L$ is discharged down to 0 volt.

The first capacitor discharging means 51 includes first switching means Q1 having one end connected to the other end of the first capacitor C1 for being at turned on during the load capacitor $C_L$ is charged from 0 to Vo/2 volt, and a first diode D1 having an anode connected to the other end of the first switching means Q1 and a cathode connected to the other end of the inductor L0 for transferring a discharge current $I_L$ from the first capacitor C1 through the first switching means Q1 to the inductor L0 during the first switching means Q1 is at turned on.

The second capacitor discharging means 53 includes second switching means Q2 having one end connected to the other end of the second capacitor C2 for being at turned on during the load capacitor $C_L$ is charged from Vo/2 to Vo volt, and a second diode D2 having an anode connected to the other end of the second switching means Q2 and a cathode connected to the inductor L0 for transferring a discharge current $I_L$ from the second capacitor C2 through the second switching means Q2 to the inductor L0 during the second switching means Q2 is at turned on.

The second capacitor charging means 55 includes third switching means Q3 having one end connected to the second capacitor C2 for being at turned on during the load capacitor $C_L$ is discharged from Vo to Vo/2, and a third diode D3 having a cathode connected to the other end of the third switching means Q3 and an anode connected to the inductor L0 for transferring a discharge current $-I_L$ from the load capacitor $C_L$ through the inductor L0 to the third switching means Q3 during the third switching means Q3 is at turned on.

The first capacitor charging means 57 includes fourth switching means Q4 having one end connected to the first capacitor C1 for being at turned on during the load capacitor $C_L$ is discharged from Vo/2 to 0 volt, and a fourth diode D4 having a cathode connected to the other end of the fourth switching means Q4 and an anode connected to the inductor L0 for transferring a discharge current $-I_L$ from the load capacitor $C_L$ through the inductor L0 to the fourth switching means Q4 during the fourth switching means Q4 is at turned on.

Besides, the first embodiment 3-step type energy recovery sustain circuit of the present invention may further includes first undershoot preventing means 61 connected between the second switching means Q2 and the second diode D2 for preventing an under shooting of the sustain pulse waveform during a discharge of the load capacitor $C_L$ from Vo to Vo/2 and holding voltages $V_L$ at both ends of the load capacitor $C_L$ at Vo/2 in combination with the third voltage sustaining means 56 if the load capacitor $C_L$ discharges down to Vo/2 volt, second undershoot preventing means 62 connected between the first switching means Q1 and the first diode D1 for preventing an under shooting of the sustain pulse waveform during a discharge of the load capacitor $C_L$ from Vo/2 to 0 volt and holding voltages $V_L$ at both ends of the load capacitor $C_L$ at 0 in combination with the fourth voltage sustaining means 58 if the load capacitor $C_L$ discharges down to 0 volt, first overshoot preventing means 63 connected between the fourth switching means and the fourth diode D4 for preventing an overshooting of the sustain pulse waveform during charging the load capacitor $C_L$ from 0 to Vo/2 volt, and second overshoot preventing means 64 connected between the third switching means Q3 and the third diode D3 for preventing overshooting of the sustain pulse waveform during charging the load capacitor $C_L$ from Vo/2 to Vo. The first undershoot preventing means 61 includes a Vo/2 power source, a fifth diode D5 having a cathode connected between the second switching means Q2 and the second diode D2, and a fifth switching means Q5 having one end connected to an anode of the fifth diode D5 and the other end connected to the Vo/2 power source for being at turned on during the load capacitor $C_L$ is discharged from Vo to Vo/2 and the voltages $V_L$ at both ends of the load capacitor $C_L$ are held at Vo/2. The second undershoot preventing means 62 includes a sixth diode D6 having a cathode connected between the first switching means Q1 and the first diode D1 and an anode grounded. The first overshoot preventing means 63 includes a Vo/2 power source, a seventh diode D7 having an anode connected between the fourth switching means Q4 and the fourth diode D4, and a sixth switching means Q6 having one end connected to a cathode of the seventh diode D7 and the other end connected to the Vo/2 power source for being at turned on during the load capacitor $C_L$ is charged from 0 to Vo/2 volt. The second overshoot preventing means 64 includes a Vo power source, and a eighth diode D8 having an anode connected between the third switching means Q3 and the third diode D3 and a cathode connected to the Vo power source. The first voltage sustaining means 52 includes a Vo/2 power source, a ninth diode D9 having a cathode connected to the output terminal OUT, a seventh switching means Q7 having one end connected to an anode of the ninth diode D9 and the other end connected to the Vo/2 power source for being turned on when the load capacitor $C_L$ is charged from 0 to Vo/2 volt.

The second voltage sustaining means 54 includes a Vo power source, a tenth diode D10 having a cathode connected to the output terminal OUT, and an eighth switching means Q8 having one end connected to an anode of the tenth diode D10 and the other end connected to the Vo power source for being turned on when the load capacitor $C_L$ is charged from Vo/2 to Vo volt. The third voltage sustaining means 56 includes a Vo/2 power source, an eleventh diode D11 having an anode connected to the output terminal OUT, and a ninth switching means Q9 having one end connected to a cathode of the eleventh diode D11 and the other end connected to the Vo/2 power source for being turned on when the load capacitor $C_L$ is discharged from Vo to Vo/2 volt. The fourth voltage sustaining means 58 includes a twelfth diode D12 having an anode connected to the output terminal OUT, and a tenth switching means Q10 having one end connected to a cathode of the twelfth diode D12 and the other end grounded for being turned on when the load capacitor $C_L$ is discharged from Vo/2 to 0 volt.

Figure 4A:
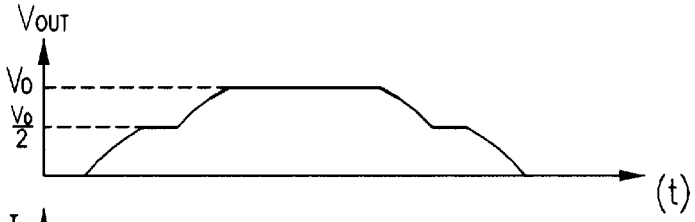
FIGS. 4*a*~4*l* illustrate a voltage waveform at an output terminal shown in FIG. 3, a current waveform flowing through an inductor, and switching timings of first to tenth switching means related to the above waveforms.
Figure 4B:
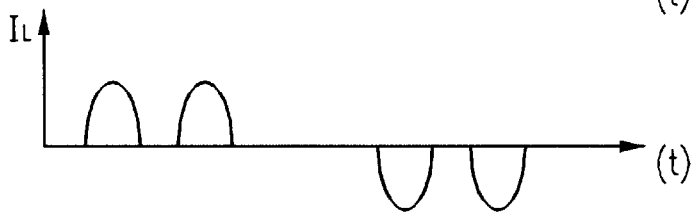
Figure 4C:
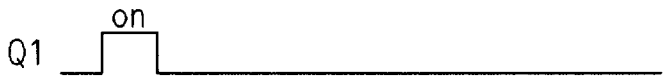
Figure 4D:
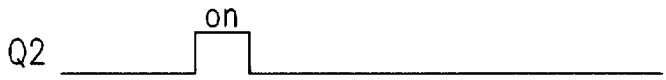
Figure 4E:
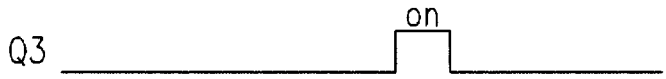
Figure 4F:
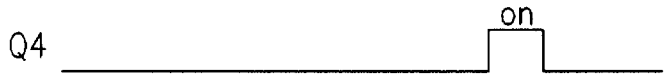
Figure 4G:
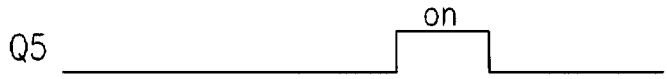
Figure 4H:
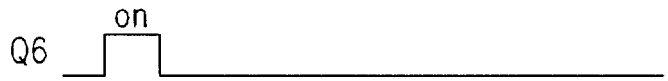
Figure 4I:
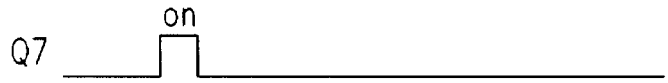
Figure 4J:
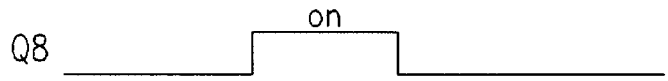
Figure 4K:
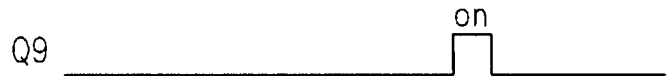
Figure 4L:
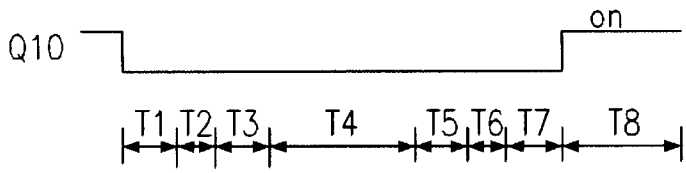

The charging and discharging operation of the 3-step type energy recovery sustain circuit in accordance with a first embodiment of the present invention will be explained with reference to FIGS. 4*a*~4*l*. FIG. 4*a* illustrates a voltage Vout waveform at the output terminal OUT, FIG. 4*b* illustrates a current $I_L$ waveform flowing through the inductor L0, FIGS. 4*c* and 4*l* illustrate switching timings of the first to tenth switching means Q1~Q10 related to the above voltage and current.

In the 3-step type energy recovery sustain circuit, when a power for an entire system is turned on to cause many times of continuous discharges occurred in the load capacitor $C_L$, the discharge current from the load capacitor $C_L$ is transmitted toward the first, and second capacitors C1 and C2 through respective inductors L0 in the first and second energy recovery sustain driving parts 50 and 70, to charge a Vo/4 voltage in each of the first capacitor C1 and a 3Vo/4 voltage to each of the second capacitors C2. When the Vo/4 volt and the 3Vo/4 volt are respectively charged in the first and second capacitors C1 and C2 in each of the first and second energy recovery sustain driving parts 50 and 70, the charging and discharging operations between the 3-step energy recovery sustain circuit and the load capacitor $C_L$ are occurred at certain intervals, performing the energy recovery sustain drive of the AC plasma display panel.

A cycle of the charging and discharging between the 3-step energy recovery sustain circuit and the load capacitor $C_L$ has 8 intervals(T1 to T8) having operations different from one another.

<T1 INTERVAL>

In this T1 interval, the first capacitors C1 in the first, and second energy recovery sustain driving parts 50 and 70 are discharged for primary charge of a discharge energy in the load capacitor $C_L$. In this instance, as shown in FIGS. 4*c* and 4*h*, only the first switching means Q1 and the sixth switching means Q6 in the first and second recovery sustain driving parts 50 and 70 are on the same time at turned on while the rest switching means Q2 to Q5 and Q7 to Q10 are at turned off. When the first switching means Q1 in each of the first and second energy recovery sustain driving parts 50 and 70 is turned on, the Vo/4 volt charged in each of the first capacitors C1 is discharged. As a result, as shown in FIG. 4*b*, the discharge current $I_L$ flows toward the load capacitor $C_L$ through the first switching means Q1, the first diode D1 and the inductor L0, to charge the load capacitor $C_L$ up to Vo/2 volt in the T1 interval with the discharge current $I_L$ from each of the first and second energy recovery sustain driving parts 50 and 70 at the end, as shown in FIG. 4*a*. Accordingly, as shown in FIG. 4*a*, in the T1 interval, a waveform rising from 0 to Vo/2, i.e., a first rising section of the sustain pulse is appears at the output terminal OUT. And, when the first switching means Q1 and the sixth switching means Q6 are turned on on the same time, the first capacitors C1 are discharged. In this instance, there are cases when an overshoot(a voltage exceeding Vo/2) appears in the waveform of the output terminal OUT. In these cases, the overshoot is absorbed to the Vo/2 power source through the seventh diode D7 and the sixth switching means Q6 in the first overshoot preventing means 63, inhibiting the overshooting of the waveform. A waveform of the current flowing through the inductor in the T1 interval is a sine wave oscillated by the resonant circuit formed with the inductor and the first capacitor. In the T2 interval after the T1 interval, when voltage to the load capacitor rises up to Vo/2 volt, the seventh switching means is turned on to sustain the voltage to the load capacitor. However, if a load on the panel, i.e., a number of on/off of the panel is changed, total capacitance of the panel is also changed, changing a resonance frequency of the resonant circuit, with a subsequent change of the rising time period of the pulse, that requires a compensation. Due to this, means for detecting an overshoot and an undershoot of peak voltages of the voltage waveform supplied to the inductor is required. When an overshoot of the peak voltage in the voltage waveform to be supplied to the inductor higher than Vo/2 is detected, the overshoot is absorbed to Vo/2 through the Q6. And, when an undershoot lower than ground is detected, the ground voltage is forced to be applied to the inductor through D6. In this instance, if an overshoot is detected, the seventh switching means is turned on even if the T1 interval is not come to an end and the waveform rising time is adjusted, for compensating the change of resonance frequency.

Figure 7:
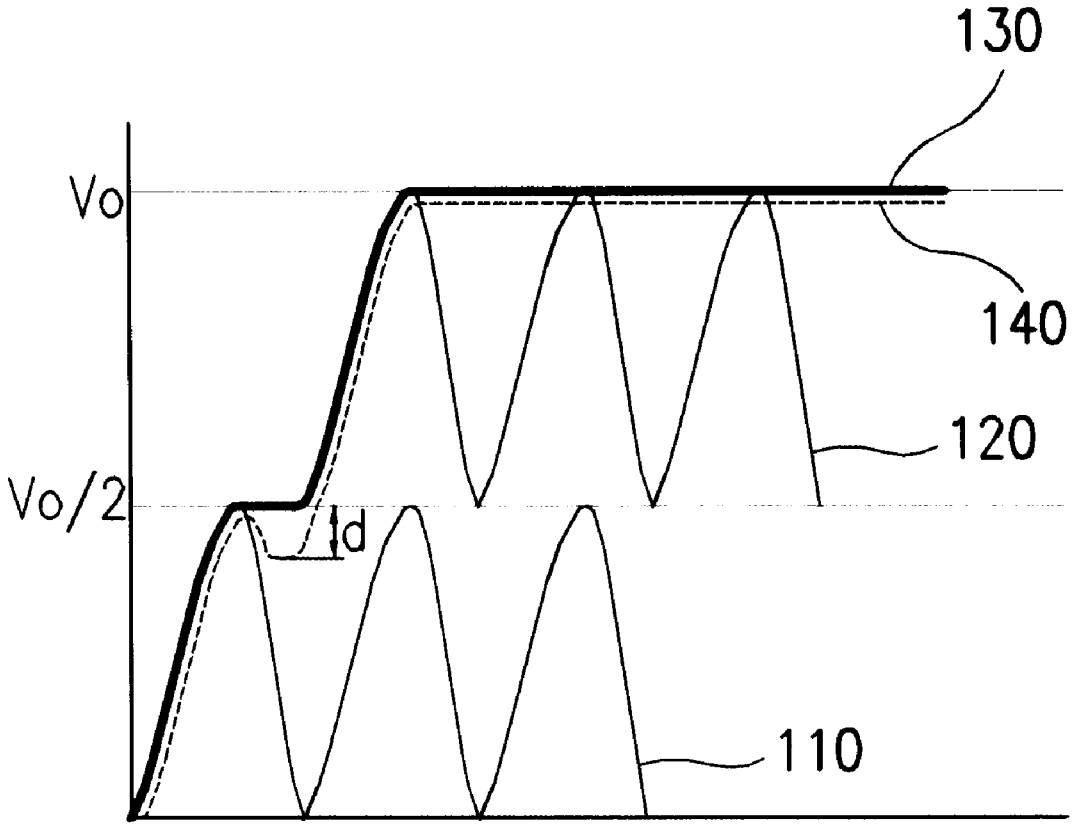
FIG. 7 illustrates a graph showing a sustain wave of which rising time is compensated according to the present invention.

FIG. 7 illustrates a sustain waveform, of which waveform rising time period is compensated for a panel load, from which it can be known that the waveform should be supplied at a peak of the resonance frequency, otherwise a voltage required for the T3 interval rises by d. The sine wave 110 represents a waveform with a resonance frequency of the resonant circuit formed between the first capacitor means and the load capacitor, the sine wave 120 represents a waveform with a resonance frequency of the resonant circuit formed between the second capacitor means and the load capacitor, the sine wave 130 represents a waveform of the rising wave of the sustain voltage of the present invention, and the sine wave 140 represents a rising sustain waveform which is not supplied at the peak resonance frequency.

<T2 INTERVAL>

In the T2 interval after the T1 interval, voltages $V_L$ at both ends of the load capacitor $C_L$ is sustained at Vo/2, to charge the Vo/2 volt to the load capacitors $C_L$, continuously. As shown in FIG. 4*i*, in this T2 interval, only the seventh switching means Q7 in the first, and second energy recovery sustain driving parts 50 and 70 are turned on, while the rest switching means Q1 to Q6, Q8 to Q10 are left turned off. When the seventh switching means Q7 in the first, and second energy recovery sustain driving parts 50 and 70 are turned on, a voltage from the Vo/2 power source is provided to the output terminal OUT through the seventh switching means Q7 and the ninth diode D9. As a result, as shown in FIG. 4*a*, the Vo/2 volt is continuously charged to the load capacitors $C_L$. That is, since the voltage V1 at both ends of the first capacitor C1 is lower than the voltage $V_L$ at both ends of the load capacitor $C_L$ in this T2 interval, there is no more discharge current $I_L$ flowing through the inductor L0. Therefore, for continuous charging to the load capacitors $C_L$, it is necessary in the T2 interval to provide a voltage from the Vo/2 power source to the output terminal OUT. Accordingly, as shown in FIG. 4*a*, in the T2 interval, a waveform held at the Vo/2 volt, i.e., a Vo/2 volt constant section of the sustain pulse appears at the output terminal OUT.

<T3 INTERVAL>

In the T3 interval after the T2 interval, discharge energies from the second capacitors C2 in the first, and second energy recovery sustain driving parts 50 and 70 are charged in the load capacitor $C_L$, again, which is already charged up to Vo/2 volt. In this instance, as shown in FIG. 4*d*, only the second switching means Q2 in the first, and second energy recovery sustain driving parts 50 and 70 are turned on while the rest switching means Q1 and Q3~Q10 are left turned off. When the second switching means Q2 in the first, and second energy recovery sustain driving parts 50 and 70 are turned on, the 3Vo/4 volt charged in the second capacitors C2 are discharged. A discharge current $I_L$ in the discharge flows toward the load capacitors $C_L$ through the second switching means Q4, the second diode D2 and the inductor L0. As a result, the load capacitors $C_L$ is charged up to Vo volt in the T3 interval by the discharge currents $I_L$ supplied from each of the first, and second energy recovery sustain driving parts 50 and 70, as shown in FIG. 4*a*. Therefore, in the T3 interval, a waveform rising from Vo/2 to Vo volt, i.e., a secondary rising section of the sustain pulse appears at the output terminal OUT, as shown in FIG. 4*a*. And, the overshoot in the waveform(a voltage exceeding Vo) at the output terminal OUT when the second capacitors C2 are discharged is absorbed to the Vo power source through the eighth diode D8 in the second overshoot preventing means 64. Thus, a waveform overshoot is prevented in the circuit of the present invention. Alike the T1 interval, in this T3 interval, a waveform of the current flowing through the inductor is a sine wave continuously oscillated by the resonant circuit formed with the inductor and the second capacitor. If voltage to the load capacitor rises up to Vo in T4 after the T3, the eighth switching means is turned on, to sustain the voltage to the load capacitor. However, if a load to the panel, i.e., a number of on/off of the panel is changed, a total capacitance of the panel is changed, with a subsequent change of a resonance frequency of a resonant circuit, changing a rising time period of the sustain pulse, that necessitates a compensation. Due to this, means for detecting an overshoot and undershoot of a peak voltage of the voltage waveform supplied to the inductor is required. When an overshoot in which a peak voltage of the waveform to be supplied to the inductor is higher than Vo is detected, the overshoot is absorbed to Vo through D8. And, when an undershoot lower than Vo/2 is detected, the Vo/2 voltage is forced to be applied to the inductor by D5 and Q5. In this instance, if the overshoot is detected, the eighth switching means is turned on even if the T3 interval is not come to an end and adjusts a rising time period of the waveform, for compensating the change of resonance frequency.

<T4 INTERVAL>

In the T4 interval after the T3 interval, voltages $V_L$ at both ends of the load capacitor $C_L$ are sustained at Vo, to keep charging the load capacitor $C_L$ at Vo volt. In this instance, as shown in FIG. 4*j*, only the eighth switching means Q8 in the first, and second energy recovery sustain driving parts 50 and 70 are turned on while the rest switching means Q1~Q7, Q9 and Q10 are left turned off. When the eighth switching means Q8 in the first, and second energy recovery sustain driving parts 50 and 70 are turned in the T4 interval, the Vo power source is provided to the output terminal OUT through the eighth switching means Q8 and the tenth diode D10, to charge the Vo volt to the load capacitor $C_L$, continuously. That is, in the T4 interval, since the voltages V2 at both ends of the second capacitor C2 are lower than the voltages $V_L$ at both ends of the load capacitors $C_L$, no more discharge current $I_L$ flows through the inductor L0. Therefore, for a continuous charging of the load capacitors $C_L$ a voltage from the Vo power source should flow to the output terminal OUT, continuously. Accordingly, in the T4 interval, a waveform held at the Vo volt, i.e., a Vo volt constant section of the sustain pulse appears at the output terminal OUT, as shown in FIG. 4*a*.

<T5 INTERVAL>

In the T5 interval after T4 interval, the load capacitors $C_L$ is discharged at the first time to charge the second capacitors C2 in the first and second energy recovery sustain driving parts 50 and 70. In this instance, as shown in FIGS. 4*e* and 4*g*, only the third switching means Q3 and the fifth switching means Q5 in the first and second energy recovery sustain driving parts 50 and 70 are turned on while the rest switching means Q1, Q2, Q4 and Q6~Q10 are left turned off. When the third switching means Q3 in the first and second energy recovery sustain driving parts 50 and 70 are turned on, the Vo volt charged in the load capacitors $C_L$ is discharged, causing a discharge current $-I_L$ generated from this discharge to flow toward each of the second capacitors C2 through the inductors L0, the third diodes D3 and the third switching means Q3 in the first and second energy recovery sustain driving parts 50 and 70. As a result, 3Vo/4 volt is charged in each of the second capacitors C2 in the T5 interval. Accordingly, in the T5 interval, a waveform falling from Vo to Vo/2 volt, i.e., a primary falling section of the sustain pulse appears at the output terminal OUT as shown in FIG. 4*a*. And, if the fifth switching means Q5 is turned on, together with the third switching means Q3, the load capacitors $C_L$ is discharged. In this instance, the possible undershoot of the waveform at the output terminal OUT (a voltage below Vo/2 volt) is suppressed by the forced supply of the Vo/2 volt from the first undershoot preventing means 61 through the fifth switching means Q5 and the fifth diode D5. A waveform of the current flowing through the inductor in this T3 interval is a sine wave continuously oscillated by the resonant circuit formed with the inductor and the second capacitor. If voltage to the load capacitor drops down to Vo/2 in T6 interval after the T5 interval, the ninth switching means is turned on, to sustain the voltage to the load capacitor. However, if a load to the panel, i.e., a number of on/off of the panel is changed, a total capacitance of the panel is changed, with a subsequent change of a resonance frequency of a resonant circuit, changing a rising time period of the sustain pulse, that necessitates a compensation. Due to this, means for detecting an overshoot and undershoot of a peak voltage of the voltage waveform supplied to the inductor is required. When an undershoot in which a peak voltage of a waveform to be supplied to the inductor is lower than Vo/2 is detected, the undershoot is prevented by forcing D5 and Q5 to sustain the Vo/2 volt. In this instance, if the undershoot is detected, the ninth switching means is turned on even if the T5 interval is not come to an end and adjusts a rising time period of the waveform, for compensating the change of resonance frequency.

<T6 INTERVAL>

In the T6 interval after the T5 interval, voltages $V_L$ at both ends of the load capacitor $C_L$ are kept at Vo/2. In this instance, as shown in FIGS. 4*k* and 4*g*, only the fifth switching means Q5 and the ninth switching means Q9 in the first and second energy recovery sustain driving parts 50 and 70 are turned on on the same time, while the rest switching means Q1~Q4, Q6~Q8 and Q10 are left turned off. If the fifth switching means Q5 and the ninth switching means Q9 in the first and second energy recovery sustain driving parts 50 and 70 are turned on on the same time in the T6 interval, a voltage at the output terminal OUT is kept at Vo/2 by the third voltage sustaining means 56 in the first undershoot preventing means 61, holding the voltages $V_L$ at both ends of the load capacitor $C_L$ at Vo/2. In this instance, since the voltage $V_L$ at both ends of the load capacitor $C_L$ are lower than the voltage V2 at both ends of the second capacitor C2, there is no more discharge current $-I_L$ flowing through the inductor L0. And, in the T6 interval, a waveform held at Vo/2 volt, i.e., a Vo/2 constant section of the sustain pulse appears at the output terminal OUT, as shown in FIG. 4*a*.

<T7 INTERVAL>

In the T7 interval after the T6 interval, the load capacitor $C_L$ discharges for the second time, charging the first capacitors C1 in the first and second energy recovery sustain driving parts 50 and 70. In this interval, as shown in FIG. 4*f*, only the fourth switching means Q4 in the first and second energy recovery sustain driving parts 50 and 70 are turned on while the rest switching means Q1~Q3 and Q5~Q10 are left turned off. When the fourth switching means Q4 in the first and second energy recovery sustain driving parts 50 and 70 are turned on, the Vo/2 volt remained in load capacitor $C_L$ is discharged, causing a discharge current $-I_L$ to flow toward the first capacitors C1 through the inductors L0, the fourth diodes D4 and the fourth switching means Q4 in the first and second energy sustain driving parts 50 and 70. As a result, each of the first capacitors C1 is charged of Vo/4 volt in the T7 interval by the discharge current $-I_L$ from load capacitor $C_L$. Accordingly, in the T7 interval, a waveform falling from Vo/2 down to 0 volt, i.e., a secondary falling section of the sustain pulse appears at the output terminal OUT, as shown in FIG. 4*a*. When there is an undershoot(a voltage below 0) occurred in the waveform at the output terminal OUT during discharge of the load capacitor $C_L$, a 0 volt is forcibly supplied through the sixth diode D6 in the second undershoot preventing means 62, to suppress the undershoot in the waveform. A waveform of the current flowing through the inductor in the T7 interval is a sine wave oscillated by the resonant circuit formed with the inductor and the first capacitor. In the T8 interval after the T7 interval, when voltage to the load capacitor drops down to a 0 volt level, the tenth switching means is turned on, applying the ground voltage, to sustain the voltage applied to the load capacitor. However, if a load on the panel, i.e., a number of on/off of the panel is changed, a total capacitance of the panel is also changed, changing a resonance frequency of the resonant circuit, with a subsequent change of the rising time period of the pulse, that necessitates a compensation. Due to this, means for detecting an overshoot and an undershoot of peak voltages of the voltage waveform supplied to the inductor is required. When an undershoot in which a peak voltage of a waveform to be supplied to the inductor is lower than ground voltage is detected, the undershoot is prevented by sustaining the ground voltage by D6. In this instance, if an undershoot is detected, the tenth switching means is turned on even if the T7 interval is not come to an end and the waveform falling time is adjusted, for compensating the change of resonance frequency.

<T8 INTERVAL>

In the T8 interval after the T7 interval, voltages $V_L$ at both ends of the load capacitor $C_L$ are held at 0. In this instance, only the tenth switching means Q10 in the first, and second energy recovery sustain driving parts 50 and 70 are turned on while the rest switching means Q1 to Q9 are left turned off. If the tenth switching means Q10 in the first, and second energy recovery sustain driving parts 50 and 70 are turned on in the T8 interval, voltages at output terminals OUT of the second undershoot preventing means 62 and the fourth voltage sustaining means 58 are held at 0, to sustain the voltages $V_L$ at both ends of the load capacitor $C_L$ at 0. In this instance, since the voltages $V_L$ at both ends of the load capacitor $C_L$ are lower than voltages V1 at both ends of the first capacitor C1, there is no more discharge current $-I_L$ flowing through the inductors L0 in the first and second energy recovery sustain driving parts 50 and 70, as shown in FIG. 4*b*. And, in the T8 interval, a waveform held at 0 volt, i.e., a 0 volt constant section of the sustain pulse appears at the output terminal OUT, as shown in FIG. 4*a*.

In conclusion, as can be known from the voltage Vout waveform of the output terminal OUT shown in FIG. 4*a*, a basic sustain waveform supplied to the load capacitor $C_L$ in the AC plasma display panel during T1 to T8 intervals is rectangular pulse. In each of the first and second rising intervals T1 and T3 and the first and second falling intervals T5 and T7, a segment of a sine wave oscillating in a resonant wave determined by the inductance of the inductor L0, the capacitance of the load capacitor $C_L$ and the capacitance of the first capacitor C1 or the second capacitor C2 appears. Thus, in the first embodiment of the present invention, the discharge energy of the load capacitor $C_L$ is stored in the first and second capacitors C1 and C2 at a ratio of 1:3, and the load capacitor $C_L$ is charged over two time using the energy stored in the first and second capacitors C1 and C2. As a result, a power consumption in a sustained operation of the panel is reduced from the background art typical type energy recovery sustain circuit. That is, as the first embodiment of the present invention, if an energy recovery sustain circuit is provided in multiple steps, lowering a voltage of external capacitor, a power consumption of the panel can be reduced in a sustained driving of the panel. In case the first embodiment sustain circuit of the present invention is driven in a frequency of $f_0$ identical to the background art typical type energy recovery sustain circuit, the power consumption is $P=2C_L(Vo/4)^2f_0$, which is less than a power consumption of in the background art of $P=C_L(Vo/2)^2f_0$ (where $C_L$ is a capacitance of a load capacitor, Vo is a sustain driving voltage, and $f_0$ is a driving frequency).

Second Embodiment

Figure 5:
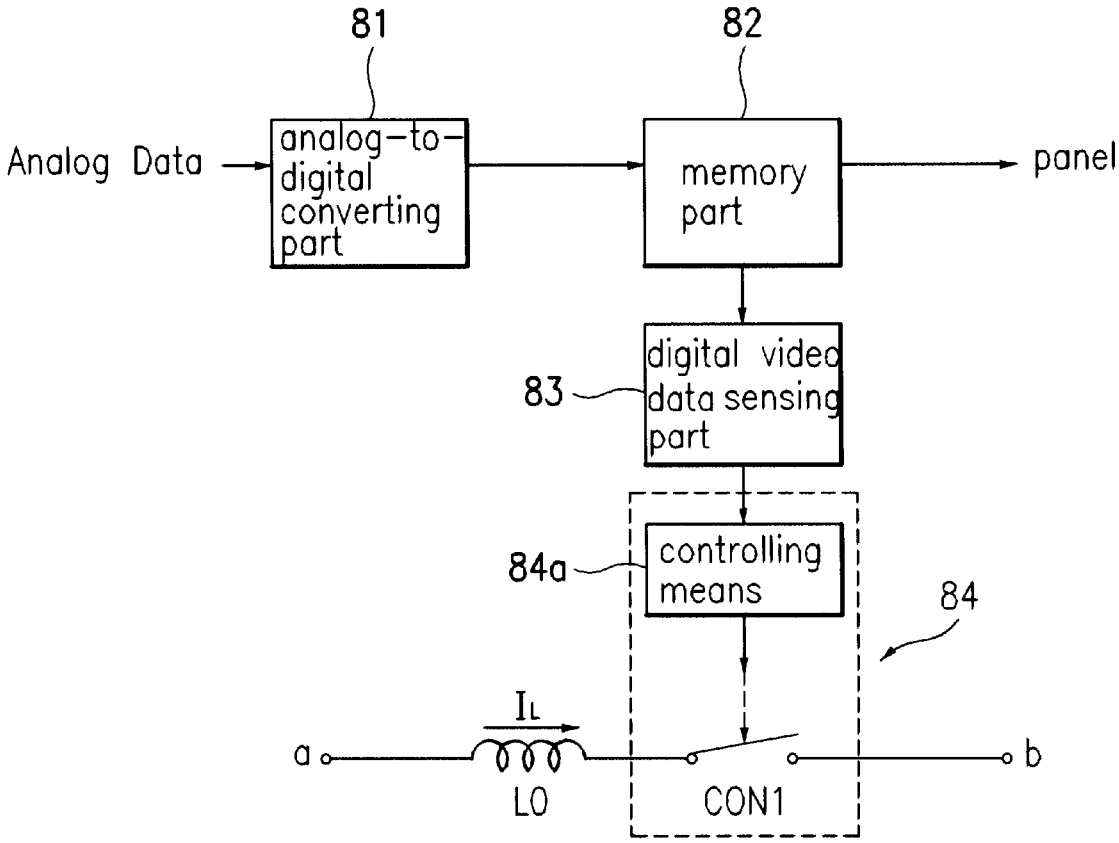
FIG. 5 illustrates a part of a system of a 3-step type energy recovery sustain circuit in accordance with a second preferred embodiment of the present invention; and, FIG. 6 illustrates a part of a system of a 3-step type energy recovery sustain circuit in accordance with a third preferred embodiment of the present invention.

A load on an AC plasma display panel, i.e., a capacitance of a load capacitor is dependent on, of a plurality of cells in the panel, a number of cells involved in address discharge with display of image. As variation of the capacitance of the load capacitor varies a resonant frequency which determines a rising time period and falling time period of a sustain pulse waveform, at the end, varies slopes of the waveform in the rising interval and falling interval of sustain pulse from each other. If forms of the sustain pulses are not constant, there may be malfunction of the AC plasma display panel due to difference in a discharge characteristic in the AC plasma display panel as well as malfunction of the energy recovery sustain circuit, degrading the effective reduction of energy loss. Therefore, as shown in FIG. 5, the second embodiment of the present invention is provided with components which can make the sustain pulse at the output terminal constant so as to match a maximum resonant point on the rising time regardless of the capacitance variation of the load capacitor in addition to the first embodiment system. The components added to the second embodiment are an analog-to-digital converting part 81 for digitizing an analog video data, a memory part 82 for storing the digitized video data from the analog-to-digital converting part 81 line by line, field by field, or frame by frame according to driving systems a digital video data sensing part 83 for sensing a number of bits which can cause an address discharge, i.e., having a logic "high", from the digital video data stored in the memory 82, and an energy compensating part 84 for determining a capacitance of the load capacitor(not shown) according to the number of bits sensed at the digital video data sensing part 83 and linearly compensating a current $I_L$ and $-I^L$ flowing between the first and second energy recovery sustain driving parts and the load capacitor for the capacitance for making the rising, and falling time periods of the sustain pulse constant regardless the variation of the capacitance of the capacitor. The energy compensating part 84 includes a switching means CON1 connected to the inductors L0 in the first and second energy recovery sustain driving parts in series for switching a current flowing through the inductor, and controlling means 84*a* for determining a capacitance of the load capacitor according to the number of bits sensed at the digital video data sensing part 83 and controlling operation of the switching means CON1 such that a turned on time period of the switching means CON1 is proportional to the capacitance of the capacitor, for controlling the current $I_L$ and $-I_L$ flowing between the first and second energy recovery sustain driving parts and the load capacitor and a rising slope of the sustain pulse. That is, the switching means CON1 controls the current under the control of the controlling means 84*a*.

The efficient energy loss reduction operation of the second embodiment of the present invention will be explained.

The analog-to-digital converting part 81 digitizes an analog video data received from outside of the circuit, and stores in the memory part 82 line by line, field by field(when driven in a subfield type), or frame by frame(when driven in subframe type) according to a driving system of the AC plasma display panel. When the memory 82 comes to store a certain amount of video data, the digital video data sensing part 83 senses a number of bits which can cause address discharges, i.e., having logic "high" from the certain amount of video data. The controlling means 84*a* in the energy compensating part 84 reads the sensed number of bits and determines the capacitance of the load capacitor. Then, when address discharges are occurred in some of the cells of the plurality of cells in the panel as an amount of video data stored in the memory part 82 is fed to the panel, the controlling means 84*a* in the energy compensating part 84 controls a turn on time period of the switching means CON1 according to the capacitance of the load capacitor in an sustained driving for the while in which the address discharge should be sustained. Thus, the current $I_L$ and $-I_L$ flowing between the first and second energy recovery sustain driving parts and the load capacitor and the maximum resonant point are controlled. In other words, if the capacitance of the load capacitor has a value greater than before, the controlling means 84*a* of the energy compensating part 84 advances a turn on time of the switching means CON1 than before in the charging or discharging of the load capacitor, to increase the current $I_L$ and $-I_L$ flowing between the first and second energy recovery sustain driving parts and the load capacitor to a required amount. And, if the capacitance of the load capacitor has a value smaller than before, the controlling means 84*a* in the energy compensating part 84 delays the turn on time of the switching means CON1 than before, to decrease the current $I_L$ and $-I_L$ flowing between the first and second energy recovery sustain driving parts and the load capacitor to a required amount. Accordingly, as the current $I_L$ and $-I_L$ flowing between the first and second energy recovery sustain driving parts and the load capacitor and the rising time of the sustain pulse are kept constant(that is, as the maximum resonant point are always fixed) regardless of the variation of the load on the AC plasma display panel i.e., the variation of the capacitance of the load capacitor, the rising time period and the falling time period of each sustain pulse is also kept constant, allowing a maximum energy loss reduction and a stable sustained driving of the panel.

Third Embodiment

Alike the second embodiment, the third embodiment of the present invention is provided with first and second energy recovery sustain driving parts, an analog-to-digital converting parts, a memory part, a digital video data sensing part and an energy compensating part, but with a difference in the energy compensating part.

Figure 6:
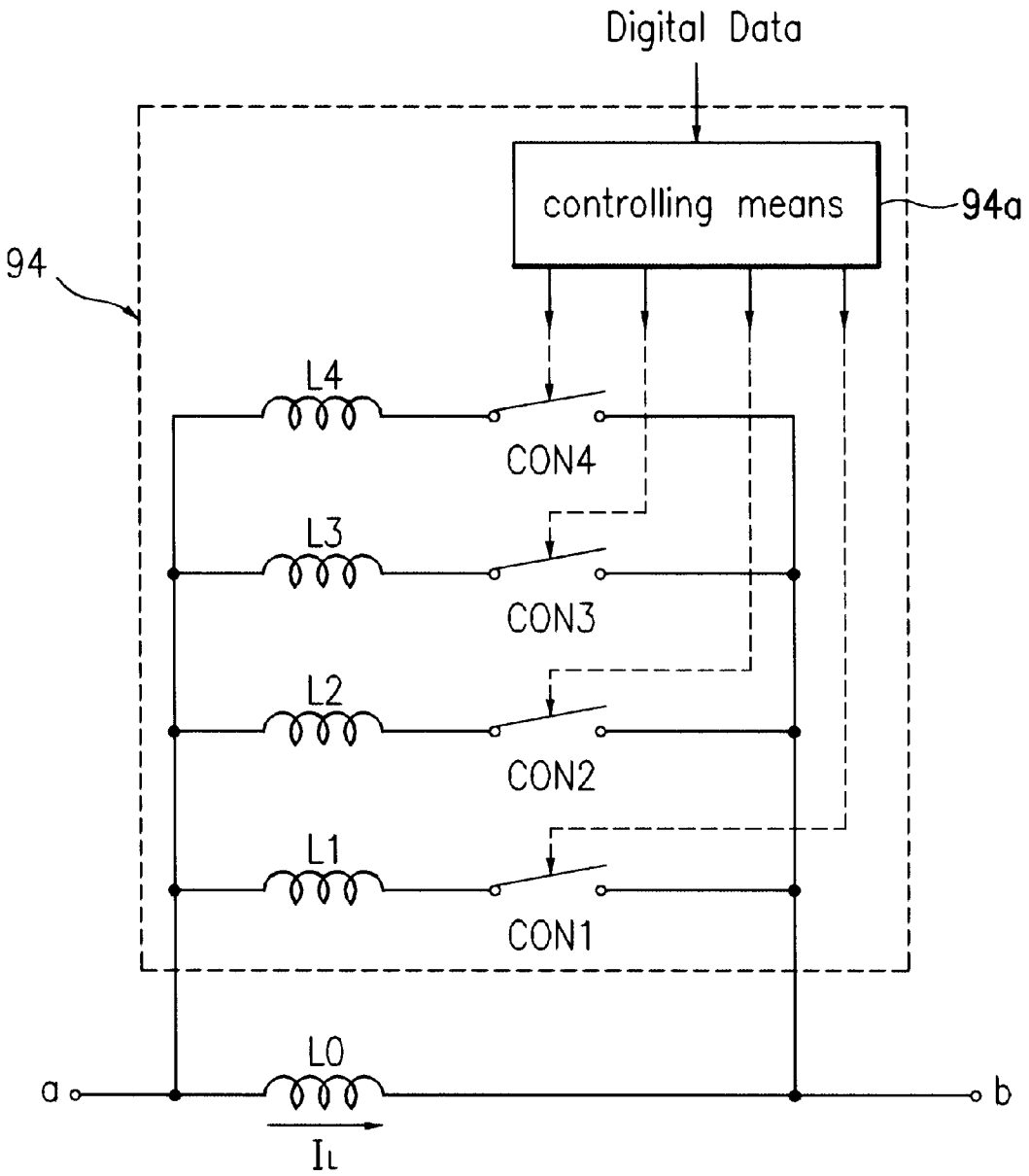

Referring to FIG. 6, the energy compensating part 94 in the third embodiment of the present invention includes four compensating inductors L1, L2, L3 and L4 connected to the inductor L0 in each of the first and second energy recovery sustain driving parts in parallel, four switching means CON1, CON2, CON3 and CON4 connected to the compensating inductors L1 to L4 in series respectively for switching operation, and a controlling means 94*a* for controlling the four switching means. Specifically, the controlling means 94*a* determines a capacitance of the load capacitor(not shown) according to a number of bits sensed at a digital video data sensing part(not shown), and controls the switching means CON1 to CON4 such that a composite inductance of the inductor L0 and the compensating inductors L1 to L4 is reversely proportional to the capacitance of the capacitor. Accordingly, the controlling means can control the current $I_L$ and $-I_L$ flowing between the first and second energy recovery sustain driving parts and the load capacitor and the rising time period of the sustain pulse constant(that is, the maximum resonant points are always fixed).

The efficient energy loss reduction operation of the second embodiment of the present invention will be explained.

An analog-to-digital converting part(not shown) digitizes an analog video data received from outside of the circuit, and stores in a memory part(not shown) line by line, field by field(when driven in a subfield type), or frame by frame (when driven in subframe type) according to a driving system of the AC plasma display panel. When the memory part comes to store a certain amount of digital video data, a digital video data sensing part(not shown) senses a number of bits which can cause address discharges, i.e., having logic "high" from the certain amount of video data. The controlling means 94*a* in the energy compensating part 94 reads the sensed number of bits and determines the capacitance of the load capacitor. Then, when address discharges are occurred in some of the cells of the plurality of cells in the panel as an amount of video data stored in the memory part is fed to the panel, the controlling means 94*a* in the energy compensating part 94 controls on/off of the switching means CON1 to CON4 according to the capacitance of the load capacitor while the address discharge should be sustained, to control a composite inductance of the inductor L0 and the compensating inductors L1 to L4. Thus, the current $I_L$ and $-I_L$ flowing between the first and second energy recovery sustain driving parts and the load capacitor and the rising time of the sustain pulse are controlled constant(that is, the maximum resonant points are always fixed). In other words, if the capacitance of the load capacitor has a value increased than before, the controlling means 94*a* of the energy compensating part 94 controls on/off of the first to fourth switching means CON1 to CON4 appropriately such that a composite inductance of the inductor L0 and the four compensating inductors L1 to L4 decreases by the amount of increase of the capacitance. And, if the capacitance of the load capacitor has a value decreased than before, the controlling means 94*a* in the energy compensating part 94 controls on/off of the first to fourth switching means CON1 to CON4 appropriately such that the composite inductance increase by the decrease of the capacitance. Of the cells in the plasma display panel, if numbers both of turned on and turned off cells vary(that is, if a luminance of the screen varies), a load on the energy recovery circuit varies. In this instance, if the inductance is constant, the plasma display panel may malfunction due to a changed discharge characteristic coming from change in the pulse rising time period. As the third embodiment of the present invention can vary an overall inductance with a plurality of inductances connected in parallel and with combinations of a plurality of switches, it is possible to control the inductance according to the load on the plasma display panel. The inductance can be adjusted in steps of 2 raised to the power of a number of the inductances connected in parallel. That is, if the number of inductances connected in parallel is n, the steps of the inductance adjustment will be $2^n$. Accordingly, the current $I_L$. and $-I_L$ flowing between the first and second energy recovery sustain driving parts and the load capacitor can be always kept constant regardless of the variation of the load on the AC plasma display panel, i.e., of the capacitance of the load capacitor. And, alike the second embodiment of the present invention, the rising time period and the failing time period of each sustain pulse is also kept constant, allowing a maximum energy loss reduction and a stable sustained driving of the panel. That is, when it is assumed that C1 denotes a capacitance of the first capacitor, C2 denotes a capacitance of the second capacitor, $L_T$ denotes a composite inductance, and $C_L$ denotes a capacitance of the load capacitor, the first rising interval of the sustain pulse is proportional to the following equation, $$\sqrt{L_T x(C_L + C1)}$$

and the second rising interval to the following equation.

$$\sqrt{L_T x(C_L + C2)}$$

Accordingly, if the composite inductance is appropriately varied with the capacitance of the load capacitor, all rising times of sustain pulses can be made constant(the same applies to the falling time of each sustain pulse). And, the more the number of the compensating inductors and the switching means connected to the inductors L0 in parallel, the finer control of the composite inductance is possible, with a more precise control of the current flowing the first and second energy recovery sustain driving parts and the load capacitor, that further improves the energy loss reduction.

As has been explained, since a plurality of capacitors are provided for temporary storage of a discharge energy of the load capacitor, which is charged back to the load capacitor many times, the present invention has an advantage in that a power consumption of the panel can be reduced than the background art panel in a sustained driving.

And, the system giving and taking charge and discharge energies to/from the load capacitor provided in the present invention allows linear compensation of the capacitance of the load capacitor. Accordingly, as the present invention provides a rising time of the sustain pulse of a maximum resonant point to the panel regardless of the variation of the capacitance of the load capacitor, an energy loss can be reduced and a stable sustained driving of the panel is possible.

It will be apparent to those skilled in the art that various modifications and variations can be made in the energy recovery sustain circuit for an AC plasma display panel of the present invention without departing from the spirit or scope of the invention. Thus, it is intended that the present invention cover the modifications and variations of this invention provided they come within the scope of the appended claims and their equivalents.

What is claimed is:

1. An energy recovery sustain circuit having first, and second energy recovery sustain driving parts for supplying sustain pulses of Vo volt to a load capacitor in an AC plasma display panel, the first, and second energy recovery sustain driving parts comprising:

an output terminal for providing sustain pulses capable of charging and discharging an external load capacitor;

inductor means connected to the output terminal in series for recovery of the voltage charged in or discharged from the load capacitor;

first capacitor means for charging or discharging the voltage recovered by the inductor means;

first discharging means for selective discharge of the voltage recovered and charged in the first capacitor means for charging the load capacitor up to a first voltage level;

first voltage sustaining means for sustaining a voltage supplied to the load capacitor by the first capacitor means at the first voltage level;

second capacitor means for charging or discharging the voltage recovered at the inductor;

second discharging means for selective discharge of the voltage recovered and charged in the second capacitor means to charge the load capacitor charged up to the first voltage up to a level of a second voltage, additionally;

second voltage sustaining means for sustaining a voltage supplied to the load capacitor by the discharge of the second capacitor at the level of the second voltage;

second charging means for being supplied of a voltage recovered by the inductor when the load capacitor charged up to the second voltage is discharged and selective charging of the second capacitor;

third voltage sustaining means for sustaining a voltage to the load capacitor at the first voltage when the load capacitor charged up to the second voltage is discharged;

first charging means for being supplied of the voltage recovered at the inductor when the load capacitor discharged down to the first voltage level discharges for the second time and selective charging of the first capacitor; and fourth voltage sustaining means for sustaining voltage at 0 volt when the load capacitor held at the first voltage is discharged for the second time.

2. An energy recovery sustain circuit as claimed in claim 1, wherein the first capacitor discharging means includes, first switching means having one end connected to the first capacitor for being at turned on during the load capacitor is charged from 0 to Vo/2 volt, and a first diode having an anode connected to the other end of the first switching means and a cathode connected to the inductor for transferring a discharge current from the first capacitor through the first switching means to the inductor during the first switching means is at turned on.

3. An energy recovery sustain circuit as claimed in claim 1, wherein the second capacitor discharging means includes, second switching means having one end connected to the second capacitor for being at turned on during the load capacitor is charged from Vo/2 to Vo volt, and a second diode having an anode connected to the other end of the second switching means and a cathode connected to the inductor for transferring a discharge current from the second capacitor through the second switching means to the inductor during the second switching means is at turned on.

4. An energy recovery sustain circuit as claimed in claim 1, wherein the second capacitor charging means includes, third switching means having one end connected to the second capacitor for being at turned on during the load capacitor is discharged from Vo to Vo/2, and a third diode having a cathode connected to the other end of the third switching means and an anode connected to the inductor for transferring a discharge current from the load capacitor through the inductor to the third switching means during the third switching means is at turned on.

5. An energy recovery sustain circuit as claimed in claim 1, wherein the first capacitor charging means includes, fourth switching means having one end connected to the first capacitor for being at turned on during the load capacitor is discharged from Vo/2 to 0 volt, and a fourth diode having a cathode connected to the other end of the fourth switching means and an anode connected to the inductor for transferring a discharge current from the load capacitor through the inductor to the fourth switching means during the fourth switching means is at turned on.

6. An energy recovery sustain circuit as claimed in claim 3, further including first undershoot preventing means connected between the second switching means and the second diode for preventing an under shooting of the sustain pulse waveform during a discharge of the load capacitor from Vo to Vo/2 and holding voltages at both ends of the load capacitor at Vo/2 in combination with the third voltage sustaining means if the load capacitor discharges down to Vo/2 volt.

7. An energy recovery sustain circuit as claimed in claim 6, wherein the first undershoot preventing means includes, a Vo/2 power source, a fifth diode having a cathode connected between the second switching means and the second diode, and a fifth switching means having one end connected to an anode of the fifth diode and the other end connected to the Vo/2 power source for being at turned on during the load capacitor is discharged from Vo to Vo/2 and the voltages at both ends of the load capacitor are held at Vo/2.

8. An energy recovery sustain circuit as claimed in claim 2, further including second undershoot preventing means connected between the first switching means and the first diode for preventing an under shooting of the sustain pulse waveform during a discharge of the load capacitor from Vo/2 to 0 volt and holding voltages at both ends of the load capacitor at 0 in combination with the fourth voltage sustaining means if the load capacitor discharges down to 0 volt.

9. An energy recovery sustain circuit as claimed in claim 8, wherein the second undershoot preventing means includes a sixth diode having a cathode connected between the first switching means and the first diode and an anode grounded.

10. An energy recovery sustain circuit as claimed in claim 5, further including first overshoot preventing means connected between the fourth switching means and the fourth diode for preventing an overshooting of the sustain pulse waveform during charging the load capacitor from 0 to Vo/2 volt.

11. An energy recovery sustain circuit as claimed in claim 10, wherein the first overshoot preventing means includes, a Vo/2 power source, a seventh diode having an anode connected between the fourth switching means and the fourth diode, and a sixth switching means having one end connected to a cathode of the seventh diode and the other end connected to the Vo/2 power source for being at turned on during the load capacitor is charged from 0 to Vo/2 volt.

12. An energy recovery sustain circuit as claimed in claim 4, further including second overshoot preventing means connected between the third switching means and the third diode for preventing overshooting of the sustain pulse waveform during charging the load capacitor from Vo/2 to Vo.

13. An energy recovery sustain circuit as claimed in claim 12, wherein the second overshoot preventing means includes, a Vo power source, and an eighth diode having an anode connected between the third switching means and the third diode and a cathode connected to the Vo power source.

14. An energy recovery sustain circuit as claimed in claim 1, wherein the first voltage sustaining means includes, a Vo/2 power source, a ninth diode having a cathode connected to the output terminal, and a seventh switching means having one end connected to an anode of the ninth diode and the other end connected to the Vo/2 power source for being turned on when the load capacitor is charged from 0 to Vo/2 volt.

15. An energy recovery sustain circuit as claimed in claim 1, wherein the second voltage sustaining means includes, a Vo power source, a tenth diode having a cathode connected to the output terminal, and an eighth switching means having one end connected to an anode of the tenth diode and the other end connected to the Vo power source for being turned on when the load capacitor is charged from Vo/2 to Vo volt.

16. An energy recovery sustain circuit as claimed in claim 1, wherein the third voltage sustaining means includes, a Vo/2 power source, an eleventh diode having an anode connected to the output terminal, and a ninth switching means having one end connected to a cathode of the eleventh diode and the other end connected to the power source for being turned on when the load capacitor is discharged from Vo to Vo/2 volt.

17. An energy recovery sustain circuit as claimed in claim 1, wherein the fourth voltage sustaining means includes, a twelfth diode having an anode connected to the output terminal, and a tenth switching means having one end connected to a cathode of the twelfth diode and the other end grounded for being turned on when the load capacitor is discharged from Vo/2 to 0 volt.

18. An energy recovery sustain circuit as claimed in claim 1, wherein the first voltage is Vo/2 and the second voltage is Vo.

19. An energy recovery sustain circuit as claimed in claim 1, wherein the first capacitor is applied of Vo/4 volt and the second capacitor is applied of 3Vo/4 volt.

20. An energy recovery sustain circuit as claimed in claim 1, further comprising means for controlling the rising or falling time period of the sustain pulse by controlling a rate of current flowing through the inductor according to a load on the load capacitor.

21. An energy recovery sustain circuit as claimed in claim 20, wherein the means for controlling the rising or falling of the sustain pulse is means for controlling a current flowing through the inductor.

22. An energy recovery sustain circuit as claimed in claim 21, wherein the means for controlling a current flowing through the inductor includes, first switching means for controlling a rate of current flowing in a positive direction of the inductor from the first capacitor and the second capacitor to the load capacitor, and second switching means for controlling a rate of current flowing in a negative direction of the inductor from the load capacitor to the first capacitor and the second capacitor.

23. An energy recovery sustain circuit as claimed in claim 22, wherein each of the first switching means and the second switching means includes, a first switching device connected between the inductor and the first capacitor means and the second capacitor means in series, and a second switching device connected between the inductor and the load capacitor in series.

24. An energy recovery sustain circuit as claimed in claim 21, wherein the means for controlling a current flowing through the inductor includes, a plurality of inductors connected in parallel to the inductor means, and a plurality of switching means each connected to one of the inductors.

25. An energy compensating circuit for an AC plasma display panel, the AC plasma display panel having a load capacitor to which first and second energy recovery sustain driving parts supply sustain pulses of Vo voltage, the first and second energy recovery sustain driving parts comprising:

an output terminal for providing sustain pulses which charges or discharges the load capacitor;

voltage sustaining means for sustaining a voltage of the sustain pulses provided from the output terminal;

inductor means connected to the output terminal in series forming a resonant circuit for recovery of voltage charged in or discharged from the load capacitor;

capacitor means for charging or discharging voltage recovered at the inductor means;

charging means for selective charge of recovered voltage to the capacitor means;

discharging means for selective discharge of the recovered voltage from the capacitor means;

detecting means for detecting a load on the load capacitor; and, means for controlling rising or falling time period of the sustain pulses according to the load of detecting means.

26. An energy compensating circuit as claimed in claim 25, wherein the means for controlling the rising or falling time period of the sustain pulse is a switching means for controlling such that the sustain pulse is supplied at a peak of resonance frequency of the resonant circuit.

27. An energy compensating circuit as claimed in claim 25, wherein the means for controlling the rising or falling time period of the sustain pulse is means for controlling an inductance of the inductor.

28. An energy compensating circuit as claimed in claim 27, wherein the means for controlling an inductance is switching means connected to the inductor in series for controlling a rate of current flowing through the inductor.

29. An energy compensating circuit as claimed in claim 27, wherein the means for controlling an inductance includes, a plurality of inductors each having inductor means connected in parallel, and switching means each connected one of the inductors for controlling the inductance by a combination of the inductors.

30. An energy compensating circuit as claimed in claim 25, wherein the means for detecting a capacitance of the load capacitor is detecting means which detects from a video signal of an image to be displayed.

31. An energy compensating circuit as claimed in claim 30, wherein the detecting means includes, an analog-to-digital converting part for digitizing an analog video data, a memory for storing the digital video data, and determining means for detecting a number of bits which can cause an address discharge from the data stored in the memory in detecting the load on the load capacitor.

* * * * *